US008055145B2

(12) United States Patent
Tomita et al.

(10) Patent No.: US 8,055,145 B2
(45) Date of Patent: Nov. 8, 2011

(54) IMAGE FORMING APPARATUS

(75) Inventors: Norio Tomita, Nara (JP); Yoshikazu Harada, Nara (JP); Tetsushi Ito, Nara (JP); Noriaki Taguchi, Nara (JP); Yoshiteru Kikuchi, Yamatokoriyama (JP); Kenichi Isomi, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 423 days.

(21) Appl. No.: 12/335,938

(22) Filed: Dec. 16, 2008

(65) Prior Publication Data

US 2009/0180803 A1 Jul. 16, 2009

(30) Foreign Application Priority Data

Jan. 11, 2008 (JP) ..... 2008-004067

(51) Int. Cl.
*G03G 15/00* (2006.01)

(52) U.S. Cl. ..... 399/49; 399/72; 399/74

(58) Field of Classification Search ..... 399/49, 399/72, 74
See application file for complete search history.

(56) References Cited

U.S. PATENT DOCUMENTS 6,321,044 B1 11/2001 Tanaka
7,020,404 B2 3/2006 Fukuda et al.
7,027,139 B2 * 4/2006 Ogihara et al. ..... 356/218
2009/0016762 A1 * 1/2009 Ota ..... 399/74

FOREIGN PATENT DOCUMENTS

JP 09-034312 2/1997
JP 11015253 A * 1/1999
JP 2001-100597 4/2001
JP 2003-195578 7/2003
JP 2004-110018 4/2004
JP 2006-003399 1/2006

OTHER PUBLICATIONS

JPO Machine Translation of Hirobe (JP 11-015253 A).*

* cited by examiner

*Primary Examiner* — David Gray
*Assistant Examiner* — Erika J Villaluna
(74) *Attorney, Agent, or Firm* — Renner, Otto, Boisselle & Sklar, LLP

(57) ABSTRACT

An image forming apparatus includes a controller for detecting the opening and closing of a shutter from the output from an optical sensor and controlling the opening and closing operation of the shutter based on the detected result. The controller determines that if the optical sensor is turned "ON" within a predetermined period of time from when the shutter begins opening, the operation of the shutter from the closed state to the open state is correctly detected. When no reflected light is detected by the optical sensor even after a predetermined time has elapsed, the controller determines that an anomaly has occurred and closes the shutter and repeat another detecting process.

7 Claims, 18 Drawing Sheets

Density Sensor Unit (Closed State)

Density Sensor Unit (Open State)

IMAGE FORMING APPARATUS

This Nonprovisional application claims priority under 35 U.S.C. §119(a) on Patent Application No. 2008-4067 filed in Japan on 11 Jan. 2008, the entire contents of which are hereby incorporated by reference.

BACKGROUND OF THE INVENTION (1) Field of the Invention

The present invention relates to an image forming apparatus such as a printer, copier or the like, which forms an image on a sheet of paper, in particular, relating to an image forming apparatus which uses an optical sensor that detects the density and misregistration of the image in order to assure image quality.

(2) Description of the Prior Art

In image forming apparatuses based on electrophotography, a test pattern image (reference toner image) for checking whether the image forming process is executed correctly is often used. Typical examples of test pattern images include the toner image for density measurement and the toner image for positional check.

This test of the image forming process is carried out by forming a reference toner image on a trial basis, sensing the density and position of the thus formed reference toner image with an optical sensor and detecting whether a toner image having a correct density is formed at an exact position. In this test, if the conditions of the image forming process are not pertinent, the image forming process conditions are corrected in accordance with the detected result of the optical sensor. In this way, this test using a reference toner image is periodically implemented, whereby it is possible to achieve image forming operations under pertinent conditions.

In color image forming apparatuses, it is impossible to reproduce a faithful color image unless images of color separations are laid over in register with each other. To avoid this, the above-described detection, or check on whether there is any problem with toner density and image position, is periodically implemented using an optical sensor with a reference toner image.

However, the optical sensors used for toner density sensing and registration sensing have to be arranged at positions where unfixed toner passes through. Besides, the aforementioned reference toner image is formed on the transfer belt and detected by the optical sensors, and in order to achieve reliable detection, the sensors have to be positioned at the most downstream side in the image forming process.

Accordingly, quite a few amount of unfixed toner scatters when the recording medium (paper) is transferred from the toner belt to the fusing device. As a result, the unfixed toner gradually builds up on the detection surface of the sensors, possibly causing detection deterioration and detection failure.

To deal with this problem, patent document 1: Japanese Patent Application Laid-open 2001-100597, discloses a configuration in which a shutter is provided in the vicinity of the detecting surface of an optical sensor in an openable and closable manner so that the shutter will open to permit detection only for the time of measurement and can close itself otherwise, to thereby prevent adherence of unfixed toner. Further, in patent document 1, the optical sensor for detecting the light reflected off the reference toner image is made active during the opening and closing movement of the shutter so as to be used for detecting the opening and closing of the shutter by detecting the reflected light from the transfer belt. That is, check on whether the shutter is correctly opened and closed is enabled without providing a separate sensor for detecting the opening and closing of the shutter.

However, in the case having the configuration as in patent document 1, if the toner has adhered on the transfer belt when the shutter changes its position from the close state (no light of direct reflection received) to the open state (light of direct reflection received), light, emitted from the optical sensor and reflected off the toner layer, shifts out of the light path of direct reflection from the transfer belt due to the thickness of the adhered toner layer, hence the optical sensor can receive no light of direct reflection (no light of direct reflection received) and detects the shutter being closed in error even though the shutter is opened correctly.

Then, when the toner area on the transfer belt has moved away from the shutter, the optical sensor finally receives light of direct reflection and detects the shutter being open. However, at this timing, the offset cam for driving the shutter has already rotated past and gotten out of the position, causing the problem that the open/close status of the shutter becomes unstable.

SUMMARY OF THE INVENTION

In view of what has been described above, it is therefore an object of the present invention to provide an image forming apparatus including an optical sensor with a shutter, in which when the open/close status of the shutter is detected by the optical sensor, malfunction of the open/close control of the shutter due to erroneous detection of the toner on the transfer belt can be prevented.

One aspect of the present invention resides in an image forming apparatus, including: a transfer belt for receiving a toner image from a photoreceptor; a secondary transfer unit for transferring the toner image on the transfer belt to a recording medium; an optical sensor for detecting a reference toner image on the transfer belt; a shutter for protecting the detecting surface of the optical sensor; an opening/closing portion for opening and closing the shutter; and, a controller for detecting the opening and closing of the shutter from the output from the optical sensor and controlling the opening and closing operation of the shutter based on the detected result, and being characterized in that the controller determines whether the optical sensor has erroneously detected the shutter being open or closed, and when occurrence of misdetection is determined, repeating an opening and closing operation over again to perform detection.

The image forming apparatus of the present invention, au further include: a separation/contact mechanism for the transfer belt and the secondary transfer unit; and a linkage mechanism for linking the opening and closing of the shutter with the separation and contact of the secondary transfer unit.

Here, the linkage mechanism may move the shutter away from the transfer belt when the secondary transfer unit is pulled out from the main apparatus body, or may include a lever that abuts the secondary transfer unit and the shutter, the lever being moved by a driving mechanism so as to move the shutter and the secondary transfer unit into, and out of, contact with each other.

Further, in the image forming apparatus of the present invention, the optical sensor may be a sensor that detects the density of a reference toner image on the transfer belt, or may be a sensor that detects the position of a reference toner image of the transfer belt.

The image forming apparatus of the present invention may be characterized in that when a plurality of optical sensors are provided, the optical sensors are adapted to use a common shutter.

The image forming apparatus of the present invention may be characterized in that the controller monitors change of the output from the optical sensor and performs an error process when no change has been observed for a predetermined period of time or longer.

The apparatus of the present invention determines whether the optical sensor has erroneously detected the shutter being open or closed, and when occurrence of mis-detection is determined, detection is performed over again by repeating an opening and closing operation. Accordingly, it is possible to prevent mis-operation of the open/close control of the shutter due to mis-detection resulting from the toner on the transfer belt.

Further, since the opening and closing of the shutter is linked with the separation and contact of the secondary transfer unit by the linkage mechanism, the reference toner image formed on the transfer belt will not be rubbed by the secondary transfer unit, it is hence possible with the optical sensor to detect the density and position of the reference toner image in a more exact manner.

Since the linkage mechanism moves the shutter away from the transfer belt when the secondary transfer unit is pulled out from the main apparatus body, it is possible to prevent the shutter from colliding with the transfer belt surface and damaging the transfer belt when secondary transfer unit is detached from and mounted to the main body (when it is replaced).

Since, when multiple optical sensors are provided, the optical sensors are adapted to use a common shutter, the multiple optical sensors can be handled with only one set of the shutter and its opening and closing mechanism, it is hence possible to avoid parts increasing in number.

Since an error process is performed when no change has been observed for a predetermined period of time or longer by monitoring change of the output from the optical sensor, it is possible to prevent mis-operation of the open/close control of the shutter due to mis-detection.

DESCRIPTION OF THE PREFERRED EMBODIMENTS

The embodiment of the present invention will hereinafter be described with reference to the accompanying drawings.

Figure 1:
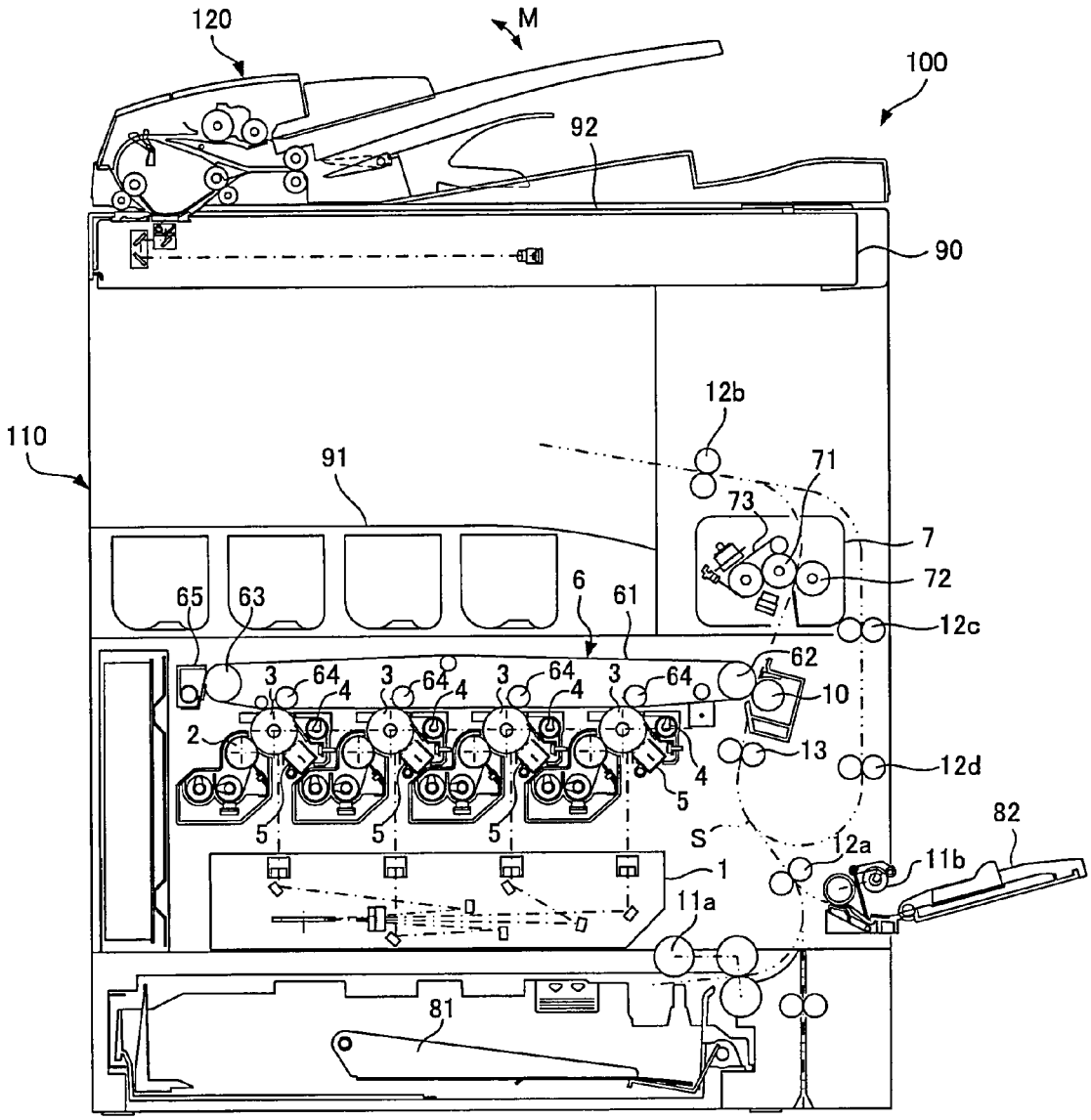
FIG. 1 is a schematic overall view showing one example of an image forming apparatus according to the present invention.

FIG. 1 shows a schematic configuration of an image forming apparatus 100 for embodying the present invention.

Image forming apparatus 100 forms a multi-colored or monochrome image on a predetermined sheet (recording paper) in accordance with image data transmitted from without, and is composed of a main apparatus body 110 and an automatic document processor 120. The main apparatus body 110 includes: an exposure unit 1; developing units 2, photoreceptor drums 3, cleaning units 4, chargers 5, an intermediate transfer belt unit 6, a fuser unit 7, a paper feed cassette 81 and a paper output tray 91.

Arranged on top of main apparatus body 110 is a document table 92 made of a transparent glass plate on which a document is placed. On the top of document table 92, automatic document processor 120 is mounted. Automatic document processor 120 automatically feeds documents onto document table 92. This document processor 120 is constructed so as to be pivotable in the bidirectional arrow M so that a document can be manually placed by opening the top of document table 92.

The image data handled in the image forming apparatus is data for color images of four colors, i.e., black (K), cyan (C), magenta (M) and yellow (Y). Accordingly, four developing units 2, four photoreceptor drums 3, four chargers 5, four cleaning units 4 are provided to produce four electrostatic latent images corresponding to black, cyan, magenta and yellow. That is, four imaging stations are constructed thereby.

Charger 5 is the charging means for uniformly electrifying the photoreceptor drum 3 surface at a predetermined potential. Other than the corona-discharge type chargers shown in FIG. 1, chargers of a contact roller type or a brush type may also be used.

Exposure unit 1 corresponds to the image writing device of the present invention, and is constructed as a laser scanning unit (LSU) having a laser emitter, reflection mirrors, etc. In this exposure unit 1, a polygon mirror for scanning a laser beam, optical elements such as lenses and mirrors for leading the laser beam reflected off the polygon mirror to photoreceptor drums 3 are laid out. The configuration of the optical scanning unit that constitutes exposure unit 1 will be described later in a specific manner.

As exposure unit 1, other methods using an array of light emitting elements such as an EL or LED writing head, for example may be used instead.

This exposure unit 1 has the function of illuminating each of the electrified photoreceptor drums 3 with light in accordance with the input image data to form an electrostatic latent image corresponding to the image data on each photoreceptor drum surface. Developing units 2 visualizes the electrostatic latent images formed on photoreceptor drums 3 with four color (YMCK) toners. Cleaning unit 4 removes and collects the toner left over on the photoreceptor drum 3 surface after development and image transfer.

Intermediate transfer belt unit 6 arranged over photoreceptor drums 3 is comprised of an intermediate transfer belt 61, an intermediate transfer belt drive roller 62, an intermediate transfer belt driven roller 63, four intermediate transfer rollers 64 corresponding to four YMCK colors and an intermediate transfer belt cleaning unit 65.

Intermediate transfer belt drive roller 62, intermediate transfer belt driven roller 63 and intermediate transfer rollers 64 support and tension intermediate transfer belt 61 to circulatively drive the belt. Each intermediate transfer roller 64 provides a transfer bias to transfer the toner image from photoreceptor drum 3 onto intermediate transfer belt 61.

Intermediate transfer belt 61 is arranged so as to contact with each photoreceptor drum 3. The toner images of different colors formed on photoreceptor drums 3 are sequentially transferred in layers to intermediate transfer belt 61, forming a color toner image (multi-color toner image) on intermediate transfer belt 61. This intermediate transfer belt 61 is an endless film of about 100 μm to 150 μm thick, for example.

Transfer of toner images from photoreceptor drums 3 to intermediate transfer belt 61 are performed by intermediate transfer rollers 64 that are in contact with the rear side of intermediate transfer belt 61. Each intermediate transfer roller 64 has a high-voltage transfer bias (high voltage of a polarity (+) opposite to the polarity (−) of the static charge on the toner) applied thereto in order to transfer the toner image. This intermediate transfer roller 64 is a roller that is formed of a base shaft made of metal (e.g., stainless steel) having a diameter of 8 to 10 mm and a conductive elastic material (e.g., EPDM, foamed urethane or the like) coated on the shaft surface. This conductive elastic material enables uniform application of a high voltage to intermediate transfer belt 61. Though in the present embodiment, rollers are used as the transfer electrodes, brushes or the like can also be used instead.

The visualized electrostatic images of color toners on different photoreceptor drums 3 are laid over one after another on intermediate transfer belt 61. The thus laminated image information is transferred to the paper as intermediate transfer belt 61 rotates, by an aftermentioned transfer roller 10 that is arranged at the contact position between the paper and intermediate transfer belt 61.

In this process, intermediate transfer belt 61 and transfer roller 10 are pressed against each other forming a predetermined nip while a voltage for transferring the toner to the paper (a high voltage of a polarity (+) opposite to the polarity (−) of the static charge on the toner) is applied to transfer roller 10. Further, in order to obtain the above nip at constant, either transfer roller 10 or intermediate transfer belt drive roller 62 is formed of a hard material (metal or the like) while the other is formed of a soft material such as an elastic roller or the like (elastic rubber roller, foamed resin roller etc.).

Since the toner adhering to intermediate transfer belt 61 as the belt comes in contact with photoreceptor drums 3, or the toner which has not been transferred by transfer roller 10 from intermediate transfer belt 61 to the paper and remains thereon, would cause color contamination of toners at the next operation, the remaining toner is adapted to be removed and collected by intermediate transfer belt cleaning unit 65. Intermediate transfer belt cleaning unit 65 includes, for example a cleaning blade as a cleaning member that comes in contact with intermediate transfer belt 61. Intermediate transfer belt 61 is supported from its interior side by intermediate transfer belt driven roller 63, at the portion where this cleaning blade comes into contact with the belt.

Paper feed cassette 81 is a tray for stacking sheets (recording paper) to be used for image forming and is arranged under exposure unit 1 of main apparatus body 110. There is also a manual paper feed cassette 82 on which sheets for image forming can be set. Paper output tray 91 arranged in the upper part of main apparatus body 110 is a tray on which the printed sheets are collected facedown.

Main apparatus body 110 further includes a paper feed path S that extends approximately vertically to convey the sheet from paper feed cassette 81 or manual paper feed cassette 82 to paper output tray 91 by way of transfer roller 10 and fuser unit 7. Arranged along paper feed path S from paper feed cassette 81 or manual paper feed cassette 82 to paper output tray 91 are pickup rollers 11*a* and 11*b*, a plurality of feed rollers 12*a* to 12*d*, a registration roller 13, transfer roller 10, fuser unit 7 and the like.

Feed rollers 12*a* to 12*d* are small rollers for promoting and supporting conveyance of sheets and are arranged at different positions along paper feed path S. Pickup roller 11*a* is arranged near the end of paper feed cassette 81 so as to pick up the paper, sheet by sheet, from paper feed cassette 81 and deliver it to paper feed path S. Similarly, pickup roller 11*b* is arranged near the end of manual paper feed cassette 82 so as to pick up the paper, sheet by sheet, from manual paper feed cassette 82 and deliver it to paper feed path S.

Registration roller 13 temporarily retains the sheet that is conveyed along paper feed path S. That is, this roller has the function of delivering the sheet toward transfer roller 10 at such a timing that the front end of the paper will meet the front end of the toner image formed on intermediate transfer belt 61.

Fuser unit 7 includes a heat roller 71 and a pressing roller 72. Heat roller 71 and pressing roller 72 are arranged so as to rotate while nipping the sheet. This heater roller 71 is set at a predetermined fusing temperature by the controller in accordance with the signal from an unillustrated temperature detector, and has the function of heating and pressing the toner to the sheet in cooperation with pressing roller 72, so as to thermally fix the toner image transferred on the sheet to the sheet by fusing, mixing and pressing the color image of multiple toners. The fuser unit further includes an external heating belt 73 for heating heat roller 71 from without.

Next, the sheet feed path will be described in detail. As stated above, the image forming apparatus has paper feed cassette 81 for storing sheets beforehand and manual paper feed cassette 82. In order to deliver sheets from these paper feed cassettes 81 and 82, pickup rollers 11*a* and 11*b* are arranged so as to lead the paper, sheet by sheet, to feed path S.

The sheet delivered from paper feed cassettes 81 or 82 is conveyed by feed rollers 12*a* on paper feed path S to registration roller 13, by which the paper is released toward transfer roller 10 at such a timing that the front end of the sheet meets the front end of the image information on intermediate transfer belt 61 so that the image information is transferred to the sheet. Thereafter, the sheet passes through fuser unit 7, whereby the unfixed toner on the sheet is fused by heat and fixed. Then the sheet is discharged through feed rollers 12*b* arranged downstream, onto paper output tray 91.

The paper feed path described above is that of the sheet for a one-sided printing request. In contrast, when a duplex printing request is given, the sheet with its one side printed passes through fuser unit 7 and is held at its rear end by the final feed roller 12*b*, then the feed roller 12*b* rotates in reverse so as to lead the sheet toward feed rollers 12*c* and 12*d*. Thereafter, the sheet passes through registration roller 13 and is printed on its rear side and discharged onto paper output tray 91.

Figure 2:
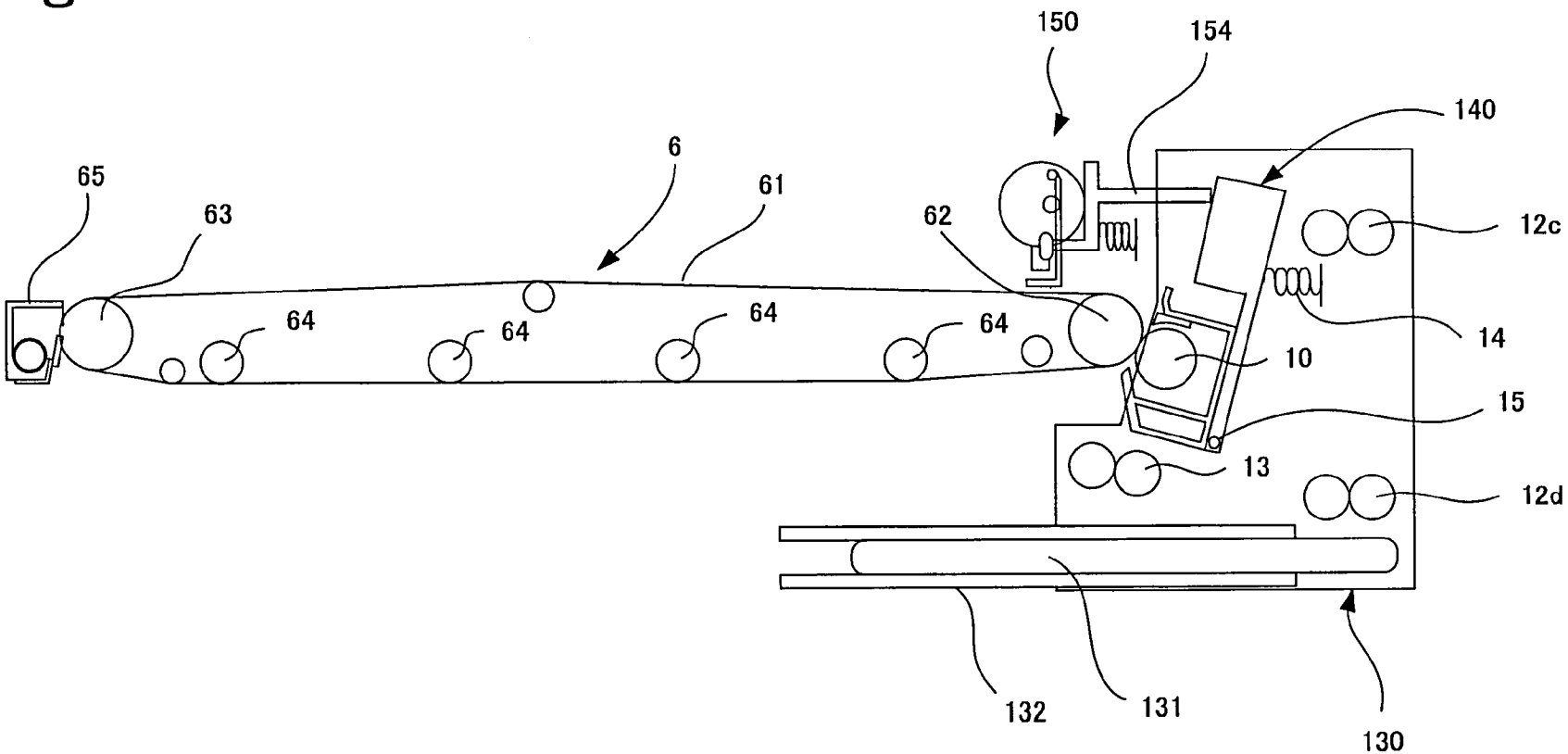
FIG. 2 is a schematic enlarged view showing a transfer portion of an image forming apparatus of the present invention.

FIG. 2 is a partial enlarged view showing a transfer portion of the image forming apparatus of the present invention.

A side unit 130 is constructed such that it can be drawn from, and mounted into, the main apparatus body along guide rails 131 and 132. This side unit 130 includes the following components.

That is, side unit 130 includes a secondary transfer unit 140, feed rollers 12*c* and 12*d* and a registration roller 13. Secondary transfer unit 140 includes transfer roller 10, and is rotatably supported about a transfer pivot 15 and is pressed against a lever 154 of an aftermentioned optical sensor unit 150 by the elastic force of a spring (large) 14.

Arranged in the proximity of side unit 130, on the main apparatus body side are the following components.

That is, intermediate transfer belt drive roller 62 is the roller for driving intermediate transfer belt 61, which is pressed by transfer roller 10.

Figure 3A:
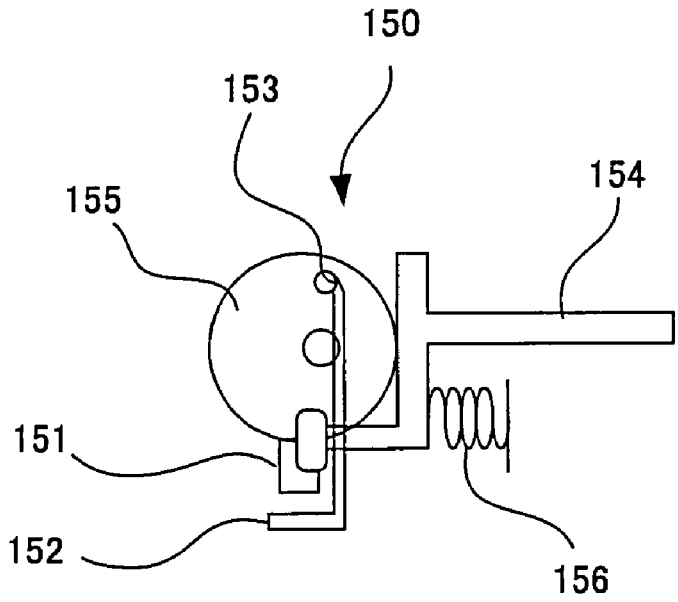
FIGS. 3A and 3B are structural views showing an optical sensor unit.
Figure 3B:
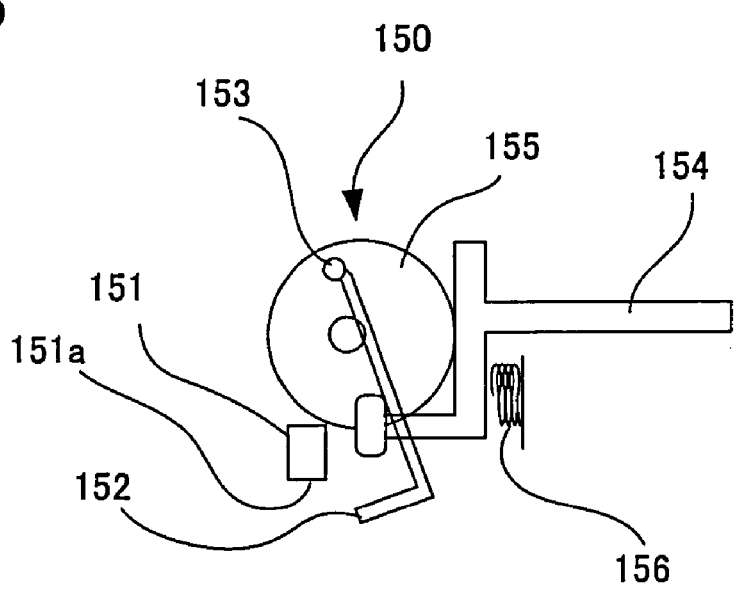

FIGS. 3A and 3B are views showing the structure of an optical sensor unit.

An optical sensor 151 includes density sensor and registration sensors. The density sensor measures the density of a first reference toner image formed on the transfer belt for controlling the processing conditions. The registration sensors are the sensors for detecting the position of a second reference toner image for color registration correction.

A shutter 152 is rotatably supported by a shutter pivot 153 and set in its closed position other than when the reference toner image is being measured, so as to protect the detection surface, designated at 151*a*, of optical sensor 151 from the toner.

Lever 154 can be moved horizontally by an offset cam 155 and is positioned with its one end abutting shutter 152 so as to open and close shutter 152. The other end of lever 154 abuts secondary transfer unit 140 so that when lever 154 is moved rightward in the drawing by the rotational action of offset cam 155, the lever opens shutter 152 while the other end of lever 154 rotates secondary transfer unit 140 clockwise to thereby move secondary transfer unit 140 away from transfer belt 61, as shown in FIG. 3B.

Offset cam 155 can be rotated by an unillustrated drive source and is rotatably supported on a camshaft.

A spring (small) 156 is provided so that its elastic force moves lever 154 rightward in the drawing.

Figure 4:
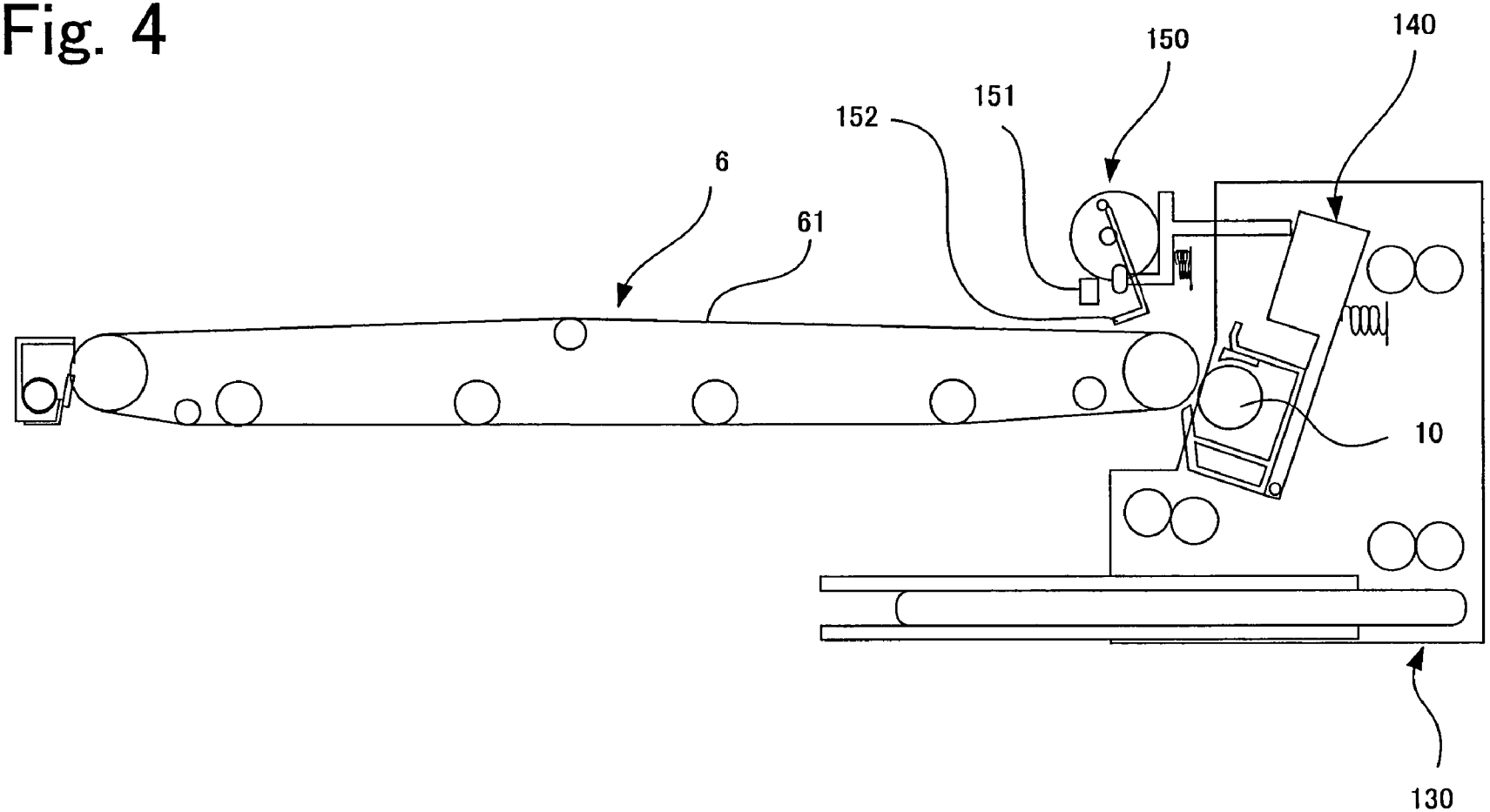
FIG. 4 is a view showing a state of a transfer portion in an image forming apparatus of the present invention when a reference toner image is being read.

FIG. 4 shows a state when a reference toner image is being read. Since, in this state, shutter 152 is open so that optical sensor 151 can detect the reference toner image on transfer belt 61 surface while transfer roller 10 is moved away from transfer belt 61, the reference toner image formed on transfer belt 61 can arrive at the front of optical sensor 151 without having been rubbed by transfer roller 10, whereby it is possible with optical sensor 151 to detect correct density and correct position.

Figure 5:
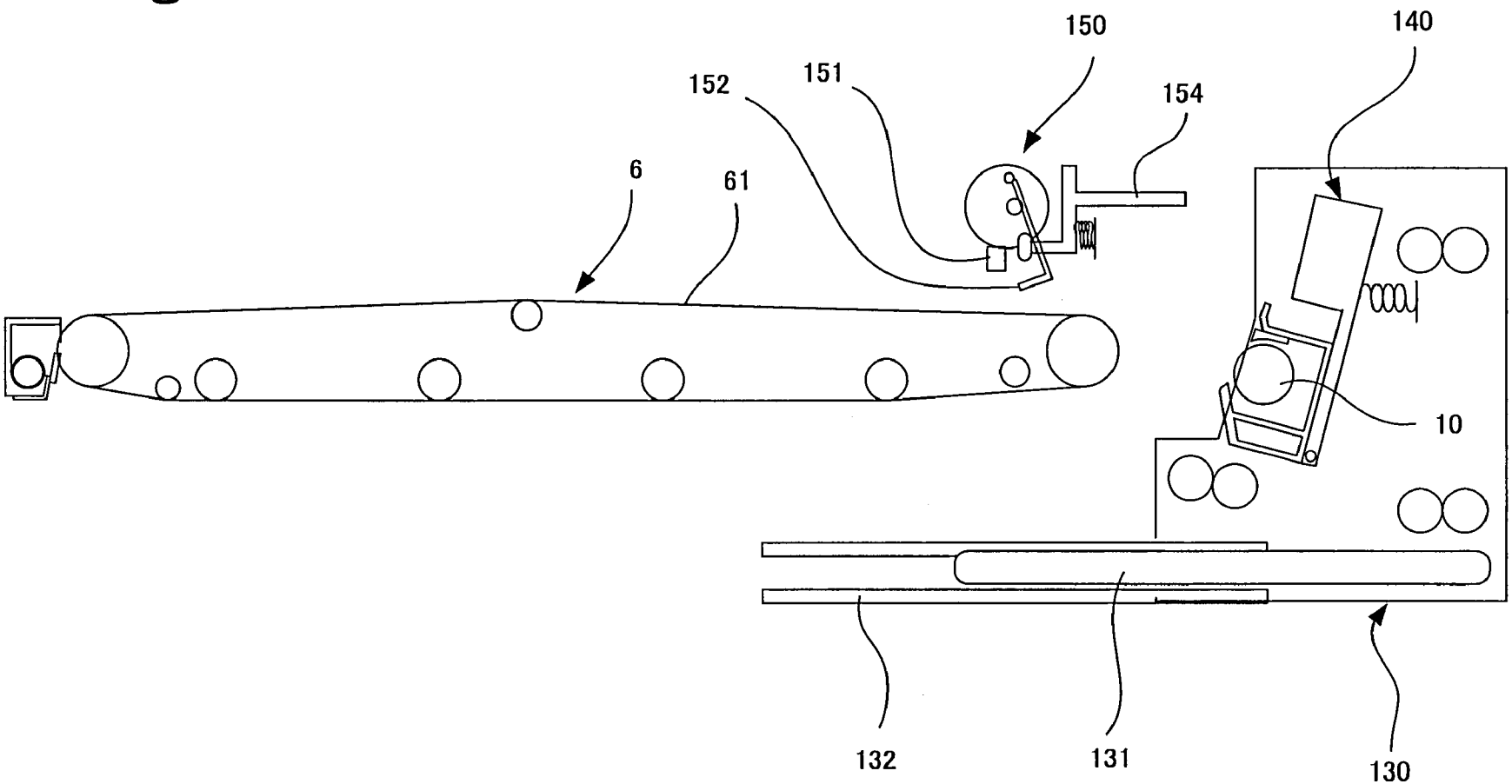
FIG. 5 is view showing a state of a transfer portion in an image forming apparatus of the present invention when a side unit is drawn out.

FIG. 5 shows a state when the side unit is pulled out. In this state, pressure of secondary transfer unit 140 against one end of lever 154 is released, and the elastic force of spring (small) 156 moves lever 145 rightward so as to open shutter 152.

Since shutter 152 is separated from the transfer belt 61 and therearound, it is possible to prevent shutter 152 from colliding with transfer belt 61 surface and damaging transfer belt 61 when transfer belt unit 6 is detached from and mounted to the main body (when the transfer belt unit is replaced).

Figure 6A:
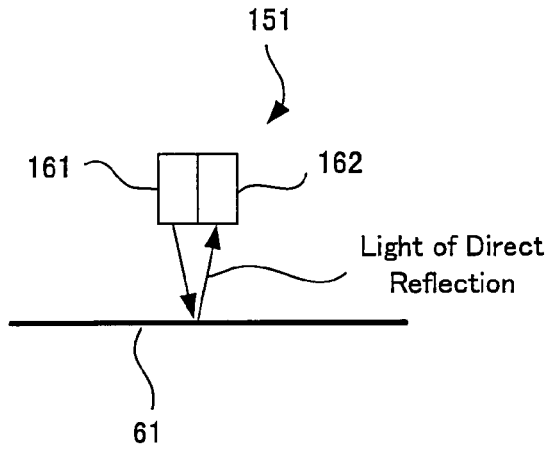
FIGS. 6A to 6C are views showing states of detection when a shutter for an optical sensor is opened and closed.
Figure 6B:
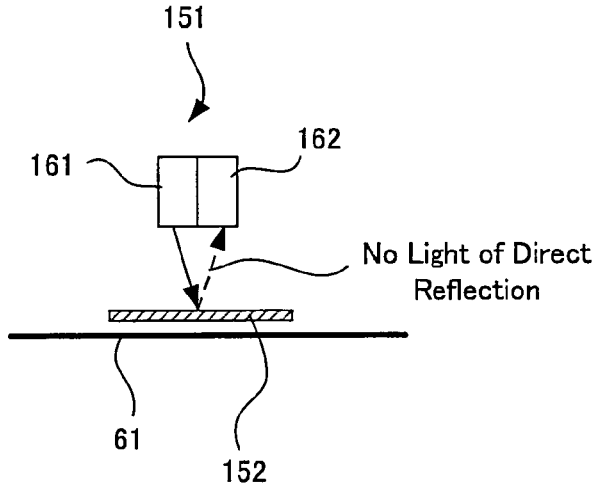
Figure 6C:
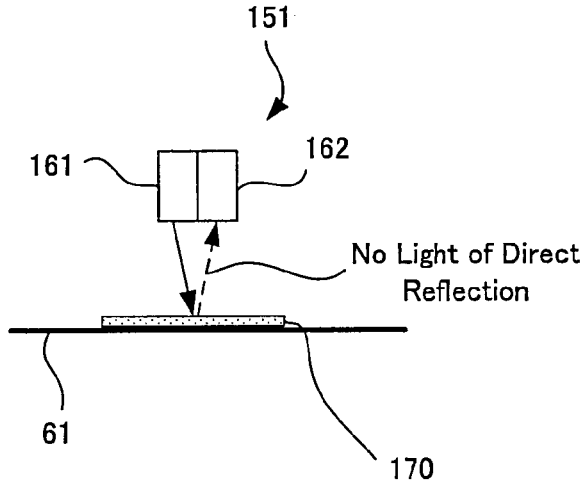

FIGS. 6A to 6C show states of detection when the shutter for the optical sensor is opened and closed. FIGS. 6A and 6C show states where shutter 152 is open while FIG. 6B shows a state where shutter 152 is closed.

Optical sensor 151 includes an LED 161 and a phototransistor 162 and detects the reference toner image by emitting an infrared ray from LED 161 onto the toner image on transfer belt 61 while detecting the light of direct reflection from the toner image by phototransistor 162, to thereby detect the toner density and the position of the toner image.

As shown in FIG. 6A, when shutter 152 is open, optical sensor 151 can detect the reflected light (light of direct reflection) from transfer belt 61. When shutter 152 is closed as shown in FIG. 6B, optical sensor 151 cannot detect any reflected light because no reflected light of direct reflection exists due to optical path difference of the infrared ray. In this way, it is possible to detect open and closed states of shutter 152.

However, even when shutter 152 is open, if a thick toner image (solid image) exists on transfer belt 61 as shown in FIG. 6C, no light of direct reflection is produced due to optical path difference of the infrared ray resulting from the thickness of the toner layer, hence optical sensor 151 cannot detect any reflected light. As a result, even though shutter 152 is open, the sensor erroneously detects the shutter being closed. The present invention is to prevent the mis-operation of the shutter due to erroneous detection of this kind.

Figure 7:
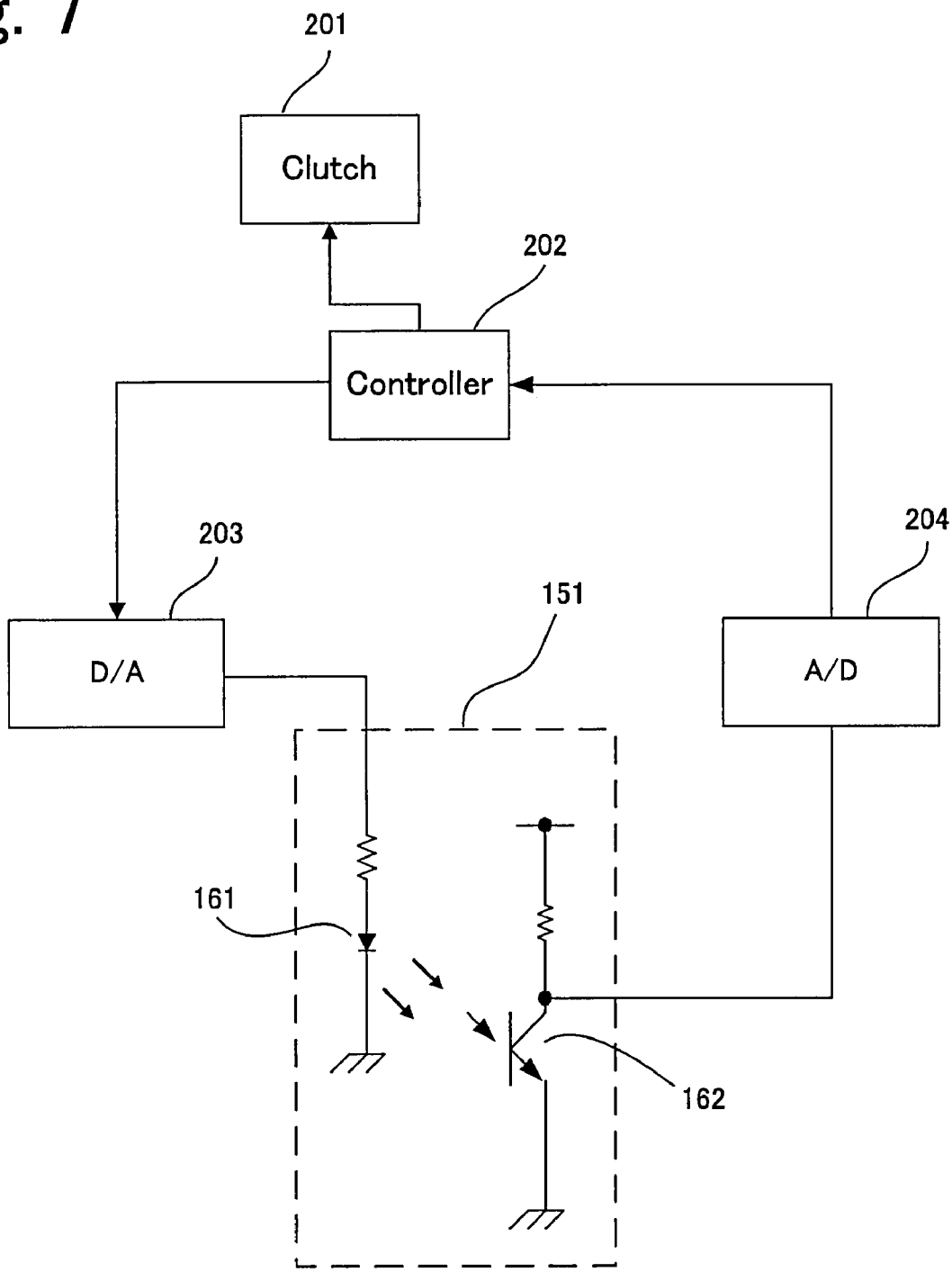
FIG. 7 is a block diagram showing an optical sensor and related components in an image forming apparatus.

FIG. 7 is a block diagram showing the optical sensor and related components in the image forming apparatus.

The light emitter is a part of optical sensor 151, specifically, infrared LED 161 that is driven by the output from a D/A converter 203. The light receiver is a part of optical sensor 151, specifically, phototransistor 162 that receives infrared rays. A/D converter 204 converts analog output from phototransistor 162 into digital values.

A controller 202 controls the drive of offset cam 155 in accordance with the output from optical sensor 151. Offset cam 155 is coupled with a motor as a drive source via a clutch 201. This offset cam 155 rotates when clutch is turned "ON".

Here, no separate drive motor for the drive source is needed by making use of the drive motor for the fusing roller.

Figure 8:
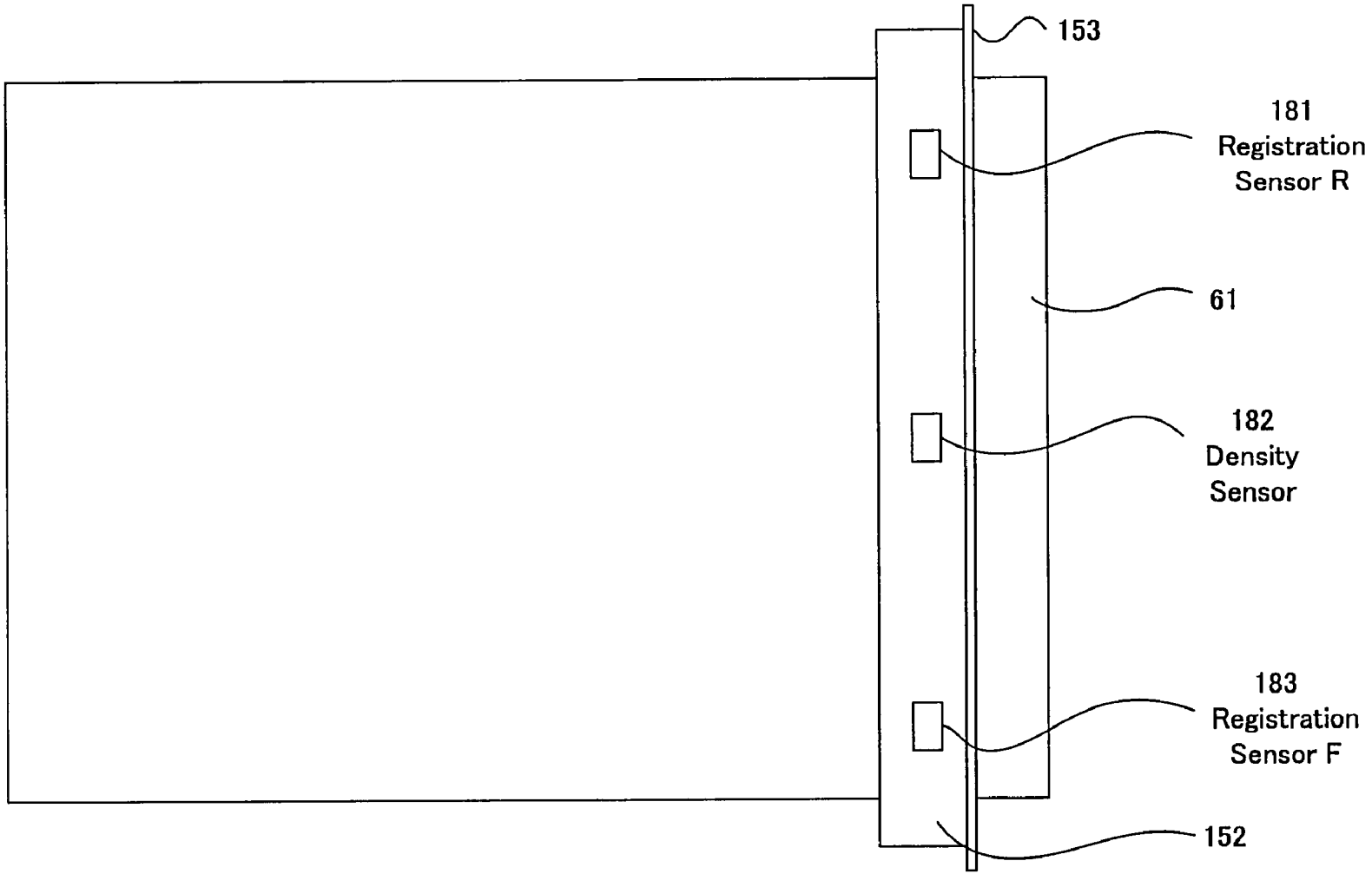
FIG. 8 is a view showing an arrangement of a transfer belt, a density sensor and registration sensors, viewed from the top of the apparatus.

FIG. 8 shows an arrangement of the transfer belt, density sensor and registration sensors, viewed from the top of the apparatus.

A pair of registration sensors 181 and 183 (registration sensors F and R) are provided at the front side and rear side of the apparatus in order to measure the image forming position by detecting the second reference toner image and make correction to the image forming position. A density sensor 182 is disposed between registration sensors 181 and 183. Density sensor 182 and registration sensors 181 and 183 are laid out in a row in the main scan direction, and their detecting surfaces are shaded and opened by common shutter 152. Accordingly, the multiple optical sensors can be handled with only one set of shutter 152 and its opening and closing mechanism, it is hence possible to avoid parts increasing in number.

Figure 9:
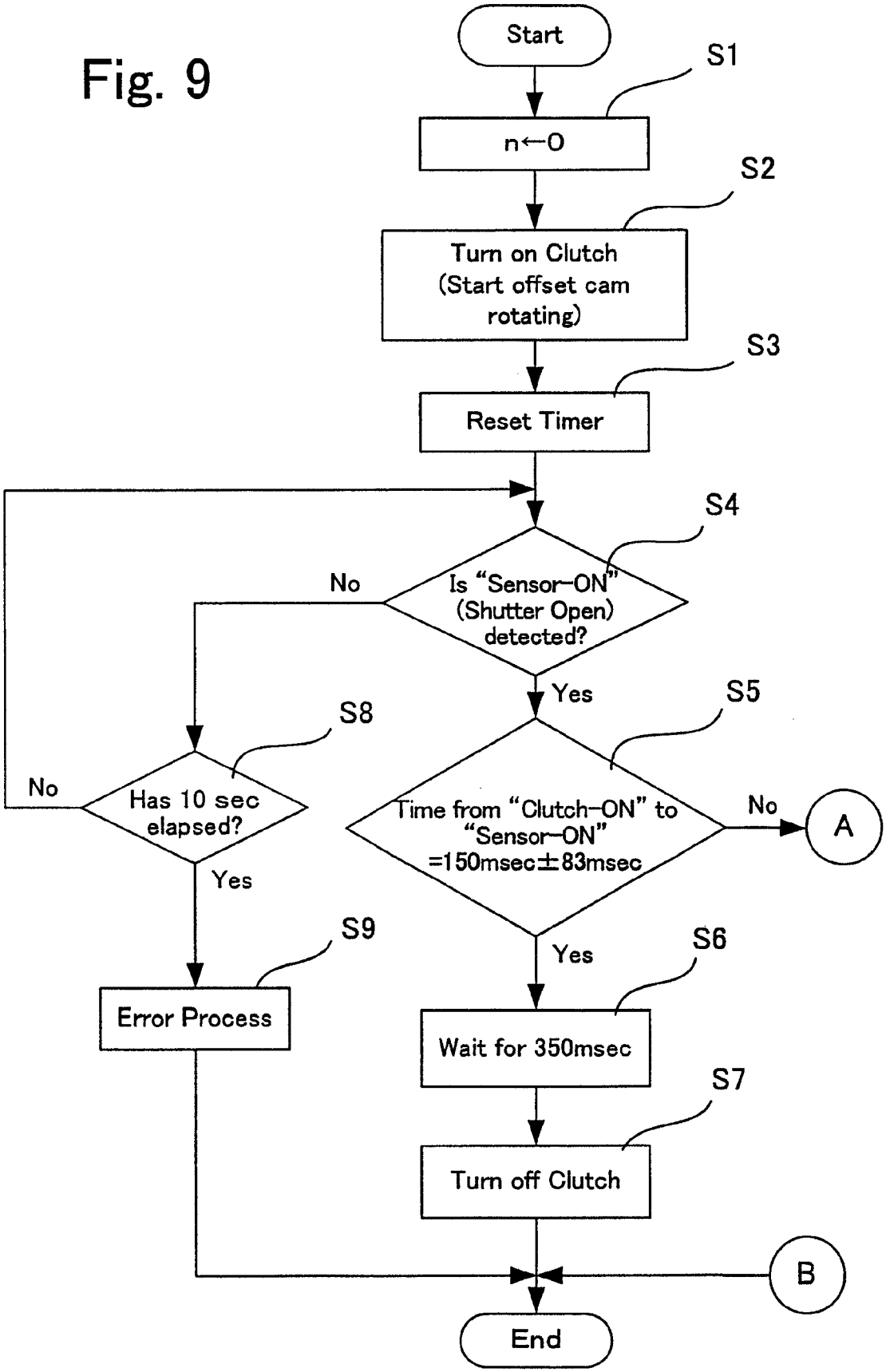
FIG. 9 is a flow chart showing "closed-to-open" control of a shutter.
Figure 10:
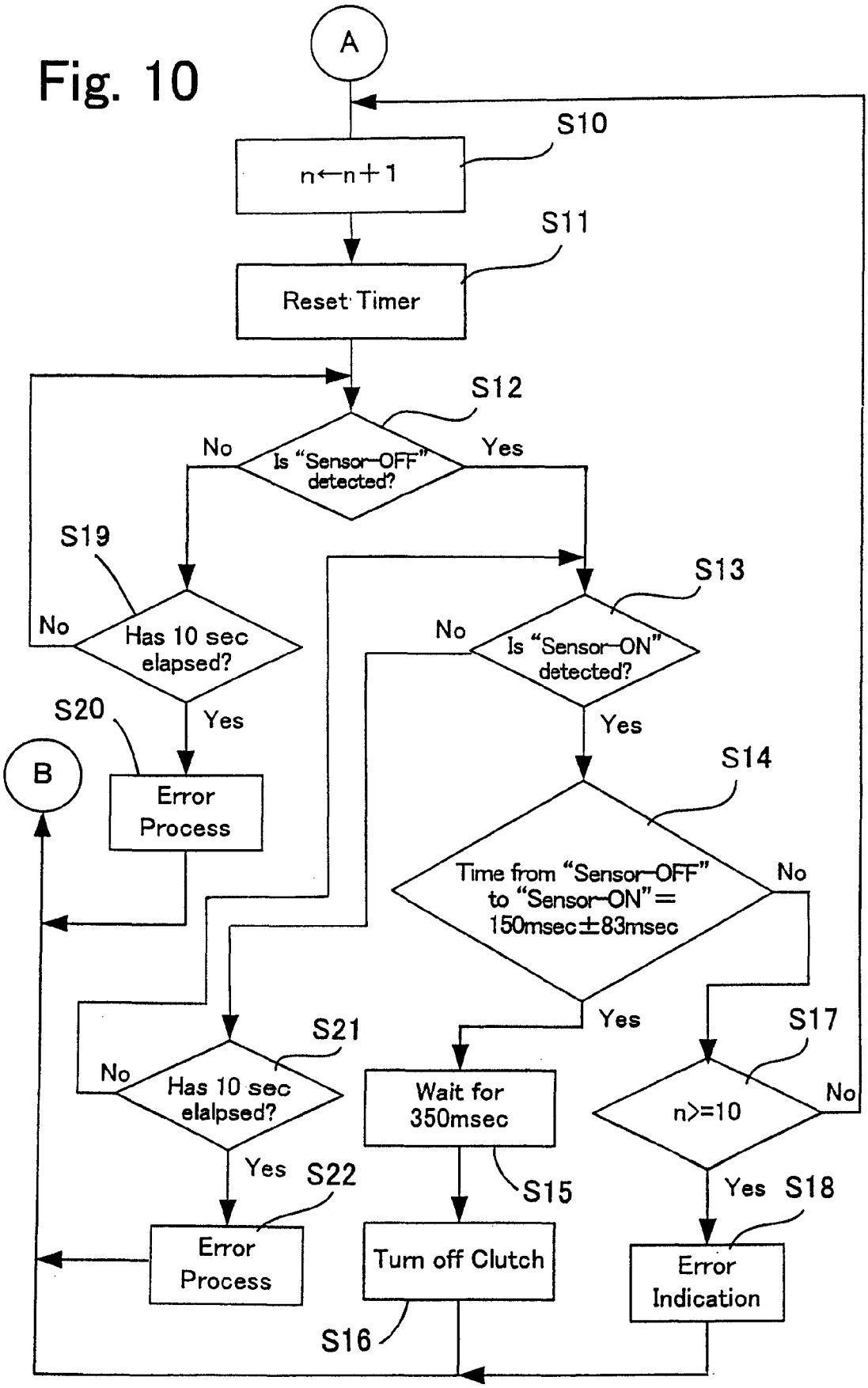
FIG. 10 is a flow chart showing "closed-to-open" control following FIG. 9.

FIGS. 9 and 10 show a "shutter closed-to-open" control flow. This flow is executed by controller 202.

A counter n is input with 0 (Step S1). Counter n counts the number of times shutter 152 has performed "closed-to-open" operations. Clutch 201 is turned "ON" to start offset cam 155 rotating (Step S2). A timer is reset (Step S3) and the control is waited until "sensor-ON" (that indicates the shutter being opened) is detected (Step S4). When "sensor-ON" is detected (Step S4; Yes), it is determined whether time from "clutch-ON" to "sensor-ON" falls within the range of 150 msec±83 msec (Step S5). If the time falls within that range, the operation is normal (Step S5; Yes), and another 350 msec is waited for (Step S6), then the clutch is turned off (Step S7) to end the operation.

Figure 11:
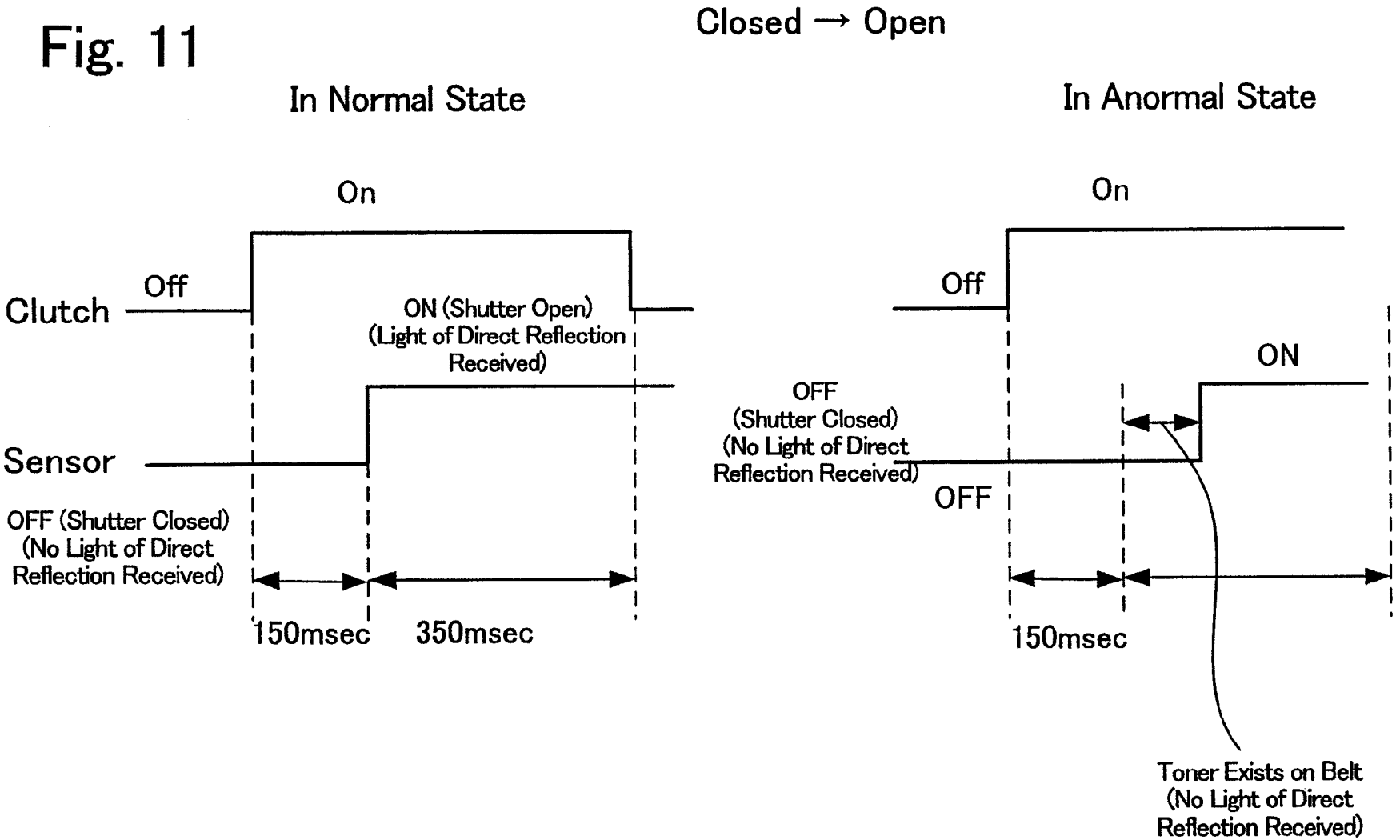
FIG. 11 shows time charts for sensor output and clutch control when "closed-to-open" control of a shutter is performed under a normal condition and under an anormal condition, respectively.

FIG. 11 shows time charts for sensor output and clutch control when "closed-to-open" control is performed under a normal condition and under an anormal condition, respectively. These time charts show the criteria for determination at Step S5.

Figure 13:
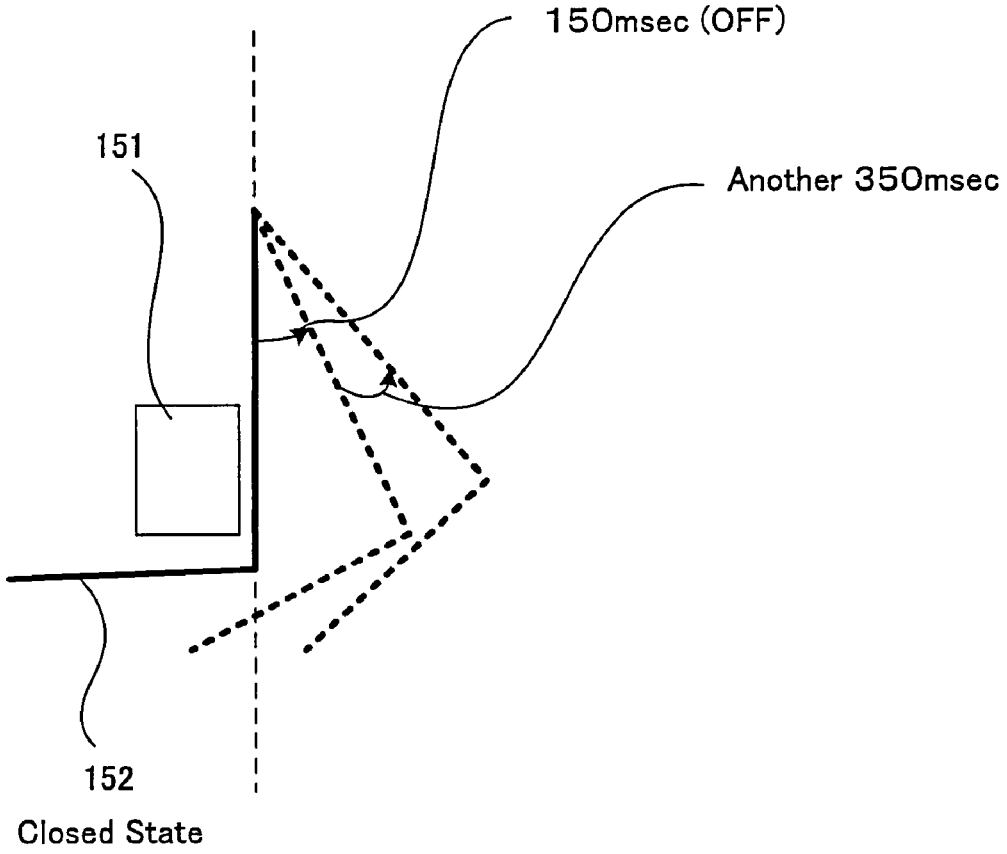
FIG. 13 is a view showing the positional angles of the shutter in "closed-to-open" control.

First, under a normal condition, time from "clutch-ON" to "sensor-ON" is within 150 msec±83 msec, as stated above. As shown in FIG. 13, this time corresponds to the time taken for shutter 152 to move from the closed state to the state where the shutter is released or moved to the position that permits optical sensor 151 to perform detection. Since, in this condition, shutter 152 has not fully opened yet, detection of the reference toner image is started after a lapse of another 350 msec so that shutter 152 can be fully opened as shown in FIG. 13.

In the anormal condition in FIG. 11, since the toner patch exists on transfer belt 61 at the position being detected by the optical sensor, no reflected light can be detected even after a lapse of 150 msec±83 msec. Then, when the toner patch has moved away from the position of detection as transfer belt 61 moves, reflected light will be able to be detected. Accordingly, controller 202 determines that there is an anomaly if the optical sensor cannot detect reflected light within the range of 150 msec±83 msec.

When no reflected light can be detected within the predetermined time range for detection at Step S5 (Step S5; No), counter n is incremented by 1 (Step S10) and the timer is reset (Step S11). Then, the control is waited until "sensor-OFF" (the shutter closed) is detected (Step S12; Yes). Further, the control is waited until detection of "sensor-ON" (the shutter open). When "sensor-ON" is detected (Step S13; Yes), it is determined whether the operation is normal (Step S14). That is, it is checked whether time from "sensor-OFF" to "sensor-ON" falls within the range of 150 msec±83 msec. When the operation is normal (Step S14; Yes), another 350 msec is waited for (Step S15), then the clutch is turned off (Step S16) to end the operation.

At Step S14, when time from "sensor-OFF" to "sensor-ON" falls beyond the range (No), the operation is not normal, hence it is determined if n is equal to or greater than 10 (Step S17). If n is equal to or greater than 10 (Step S17; Yes), an error indication is given to end the operation (Step S18). When n is not equal to or greater than 10 (Step S17; No), the control goes back to Step S10 and repeats the same operation.

Figure 12:
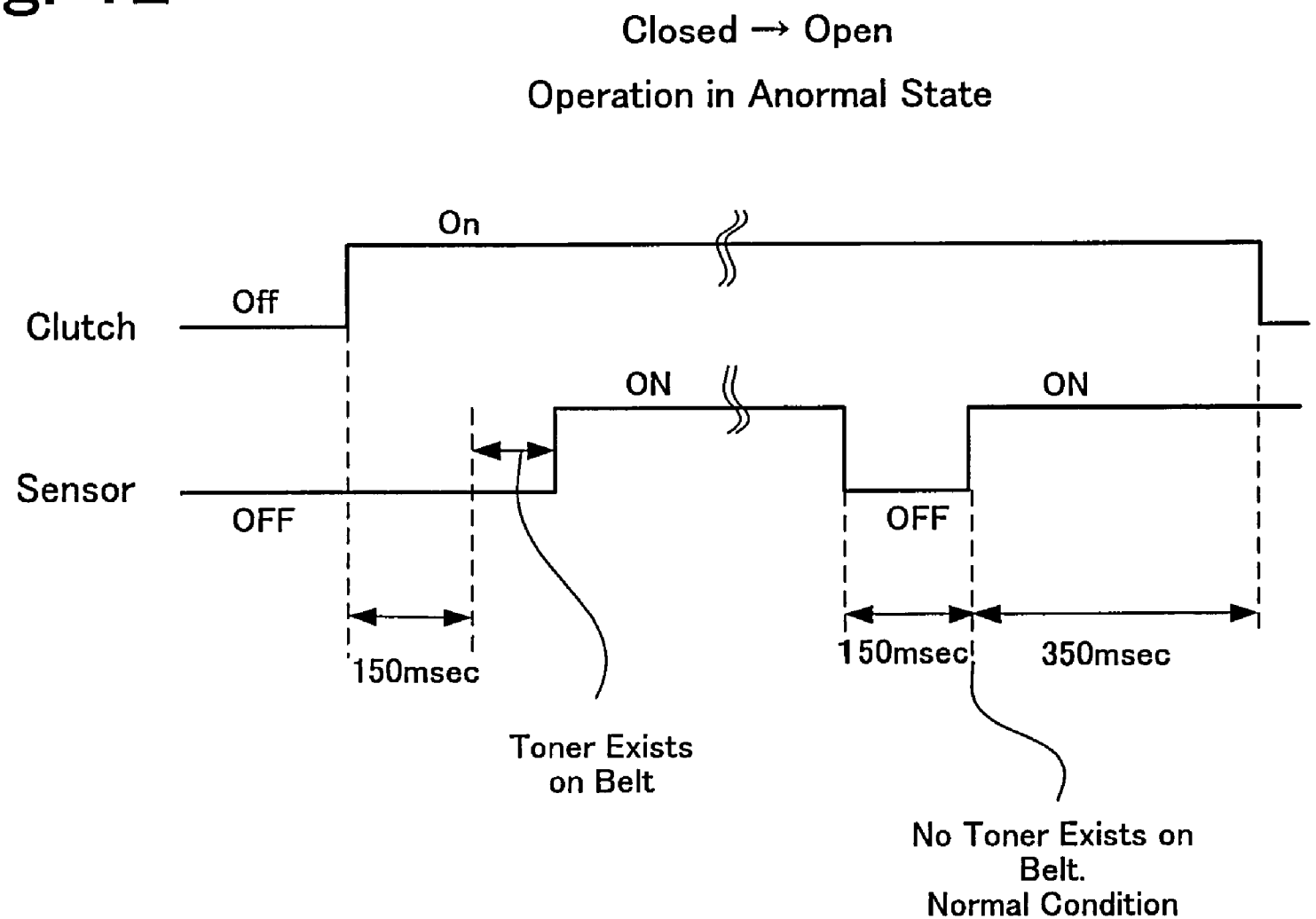
FIG. 12 is a time chart showing sensor output and clutch control in the case where control is performed following the above flow when an anormal output has occurred in the "closed-to-open" control of the shutter.

FIG. 12 shows a time chart for sensor output and clutch control in the case where the above flow control is performed when an anormal output has occurred in the "closed-to-open" control.

Similarly to FIG. 11, since the toner patch exists on transfer belt 61 at the position detected by the optical sensor, no reflected light can be detected even after a lapse of 150 msec±83 msec. Hence, this operation is determined to be anormal at Step S14, and the control returns to Step S10 and is started over again. Then, the toner patch is conveyed away as transfer belt 61 moves, and optical sensor 151 detects reflected light in a normal condition.

This loop will be repeated a number of times until the normal state is restored. However, if the loop has been repeated 10 times or greater, the detecting operation is determined to be totally impossible and an error indication is given at Step S17.

At Steps S4, S12 and S13, a loop is formed so as to wait a change of the output from the sensor from when the timer was reset at Step S3 or S11. When no output change takes place after a lapse of 10 sec from timer reset (Step S8, S19 or S21; Yes), an error indication is given to end the operation (Steps S9, S20 and S22).

Figure 14:
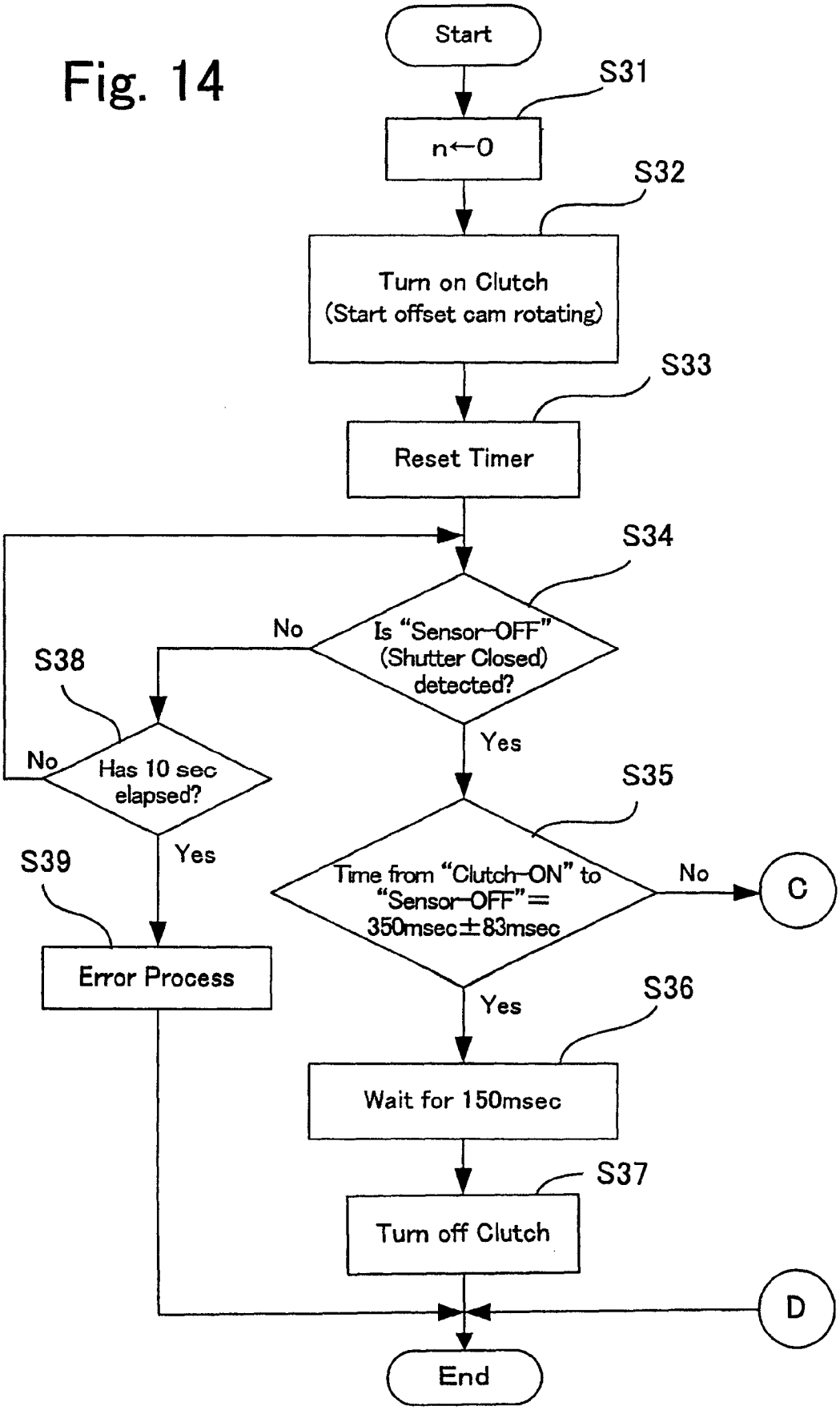
FIG. 14 is a flow chart showing "open-to-closed" control of a shutter.
Figure 15:
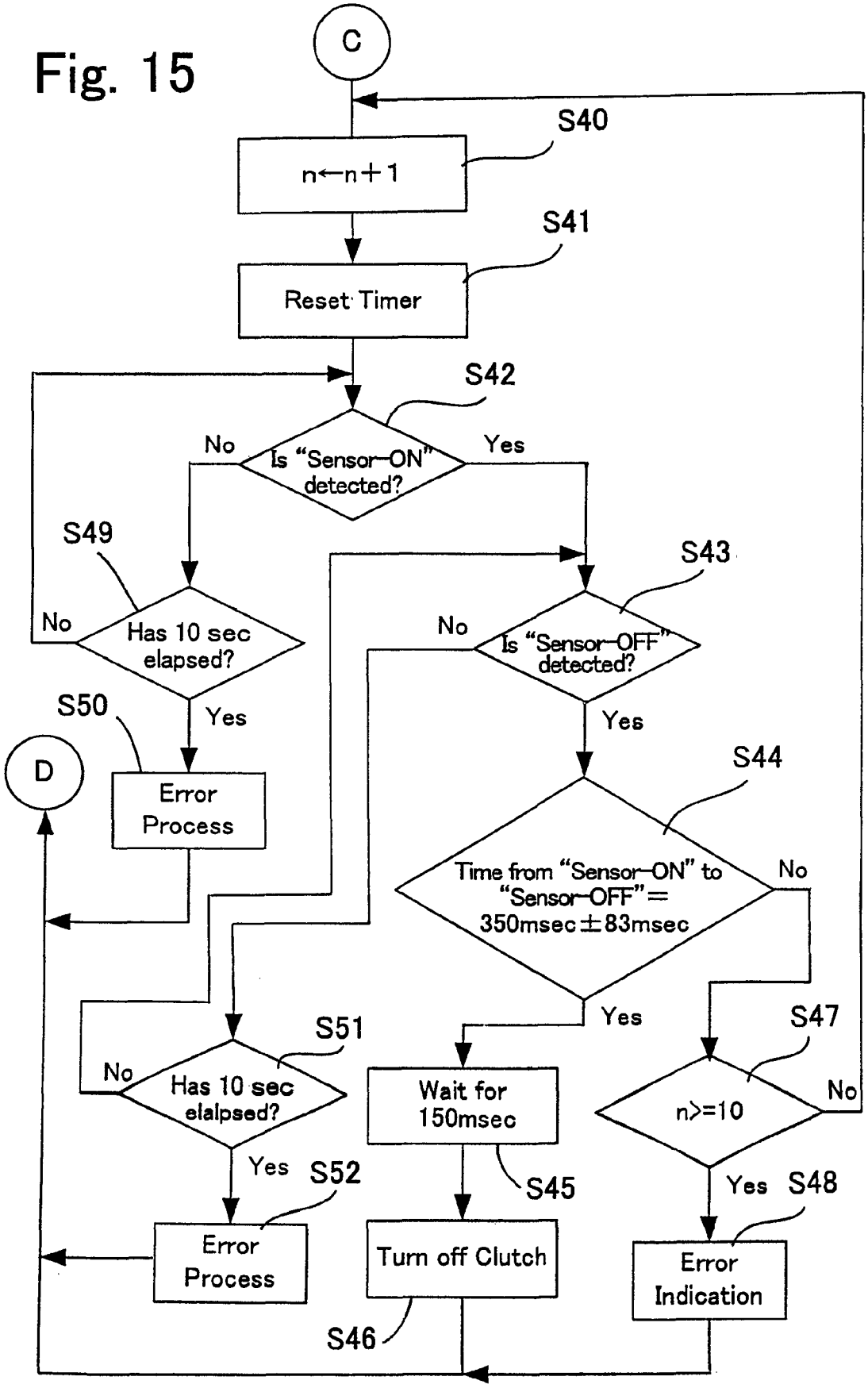
FIG. 15 is a flow chart showing "open-to-closed" control following FIG. 14.

Next, FIGS. 14 and 15 show a "shutter open-to-closed" control flow. This flow is executed by controller 202.

Counter n is input with 0 (Step S31). Counter n counts the number of times shutter 152 has performed "open-to-closed" operations. Clutch 201 is turned "ON" to start offset cam 155 rotating (Step S32). A timer is reset (Step S33) and the control is waited until "sensor-OFF" (that indicates the shutter being closed) is detected (Step S34). When "sensor-OFF" is detected (Step S34; Yes), it is determined whether time from "clutch-ON" to "sensor-OFF" falls within the range of 350 msec±83 msec (Step S35). Then the time falls within that range, the operation is normal (Step S35; Yes), and another 150 msec is waited for (Step S36), then the clutch is turned off (Step S37) to end the operation.

Figure 16:
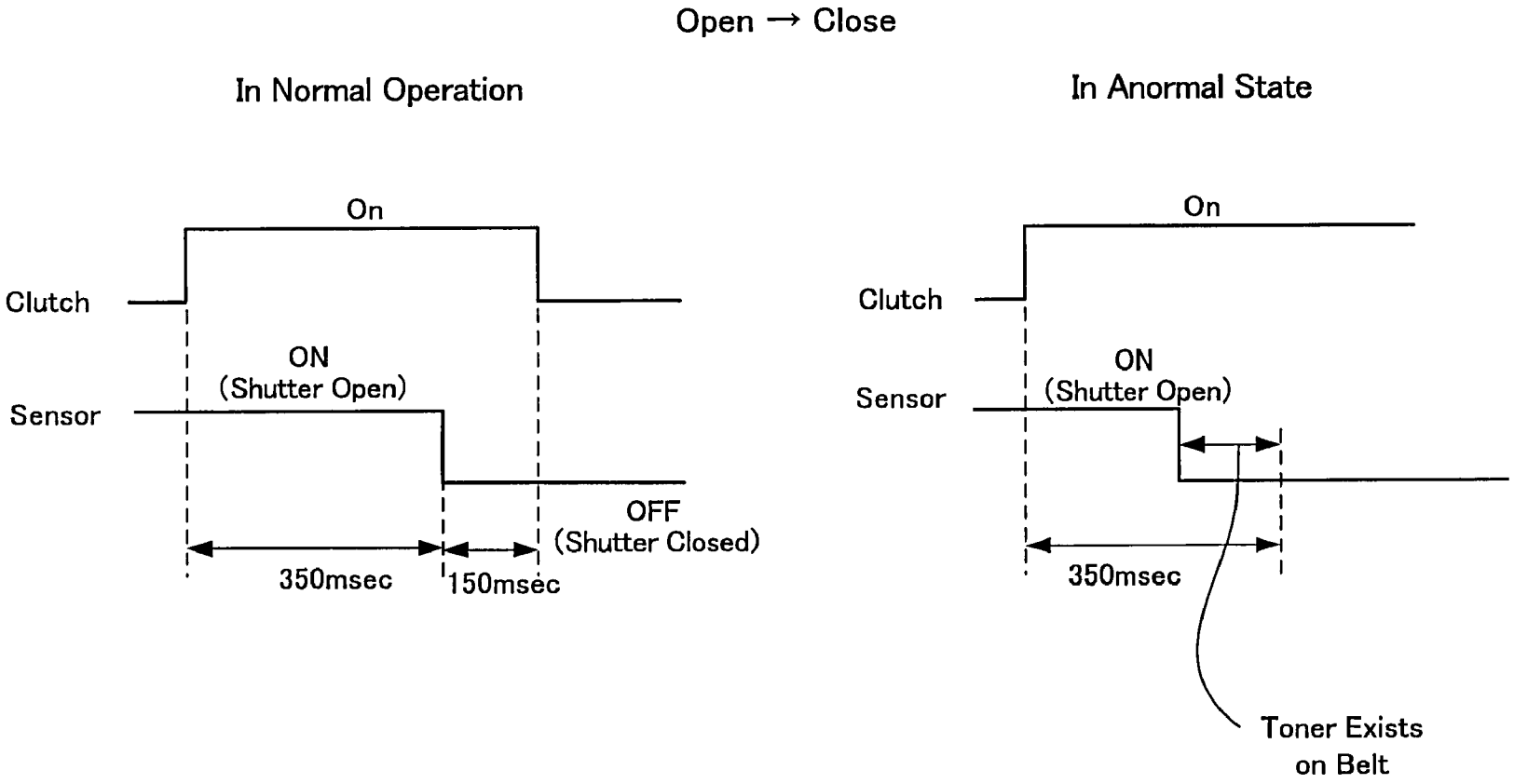
FIG. 16 shows time charts for sensor output and clutch control when "open-to-closed" control of a shutter is performed under a normal condition and under an anormal condition, respectively.

FIG. 16 shows time charts for sensor output and clutch control when "open-to-closed" control is performed under a normal condition and under an anormal condition, respectively. These time charts show the criteria for determination at Step S35.

Figure 18:
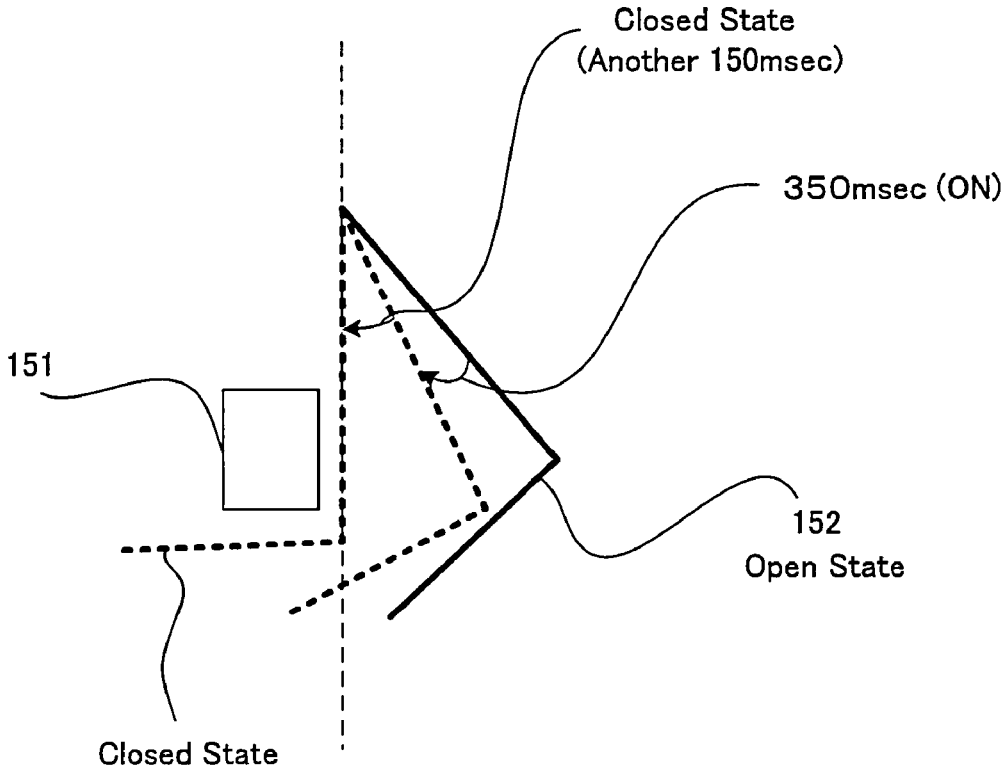
FIG. 18 is a view showing the positional angles of the shutter in "open-to-closed" control.

First, under a normal condition, time from "clutch-ON" to "sensor-OFF" is within 350 msec±83 msec, as stated above. As shown in FIG. 18, this time corresponds to the time taken for shutter 152 to move from the open state to the boundary position at which detection by optical sensor 151 is permitted. Since, in this condition, shutter 152 has not been fully closed yet, another 150 msec is waited for so as to fully close shutter 152 as shown in FIG. 18. Then, clutch 201 is turned off.

In an anormal condition in FIG. 16, since the toner patch exists on transfer belt 61 at the position detected by the optical sensor, reflected light becomes unable to be detected before a lapse of 350 msec±83 msec passes. Accordingly, controller 202 determines that there is an anomaly if the optical sensor has become unable to detect reflected light before a lapse of 350 msec±83 msec.

When no reflected light can be detected before a lapse of the predetermined time at Step S35 (Step S35; No), counter n is incremented by 1 (Step S40) and the timer is reset (Step S41). Then, the control is waited until "sensor-ON" (the shutter open) is detected (Step S42; Yes). The control is waited until "sensor-OFF" (the shutter closed). When "sensor-OFF" is detected (Step S43; Yes), it is determined whether the operation is normal (Step S44). That is, it is checked whether time from "sensor-ON" to "sensor-OFF" falls with the range of 350 msec±83 msec. When the operation is normal (Step S44; Yes), another 150 msec is waited for (Step S45), then the clutch is turned off (Step S46) to end the operation.

At Step S44, when time from "sensor-ON" to "sensor-OFF" falls beyond the range (No), the operation is not normal, hence it is determined if n is equal to or greater than 10 (Step S47). If n is equal to or greater than 10 (Step S47; Yes), an error indication is given to end the operation (Step S48). When n is not equal to or greater than 10 (Step S47; No), the control goes back to Step S40 and repeats the same operation.

Figure 17:
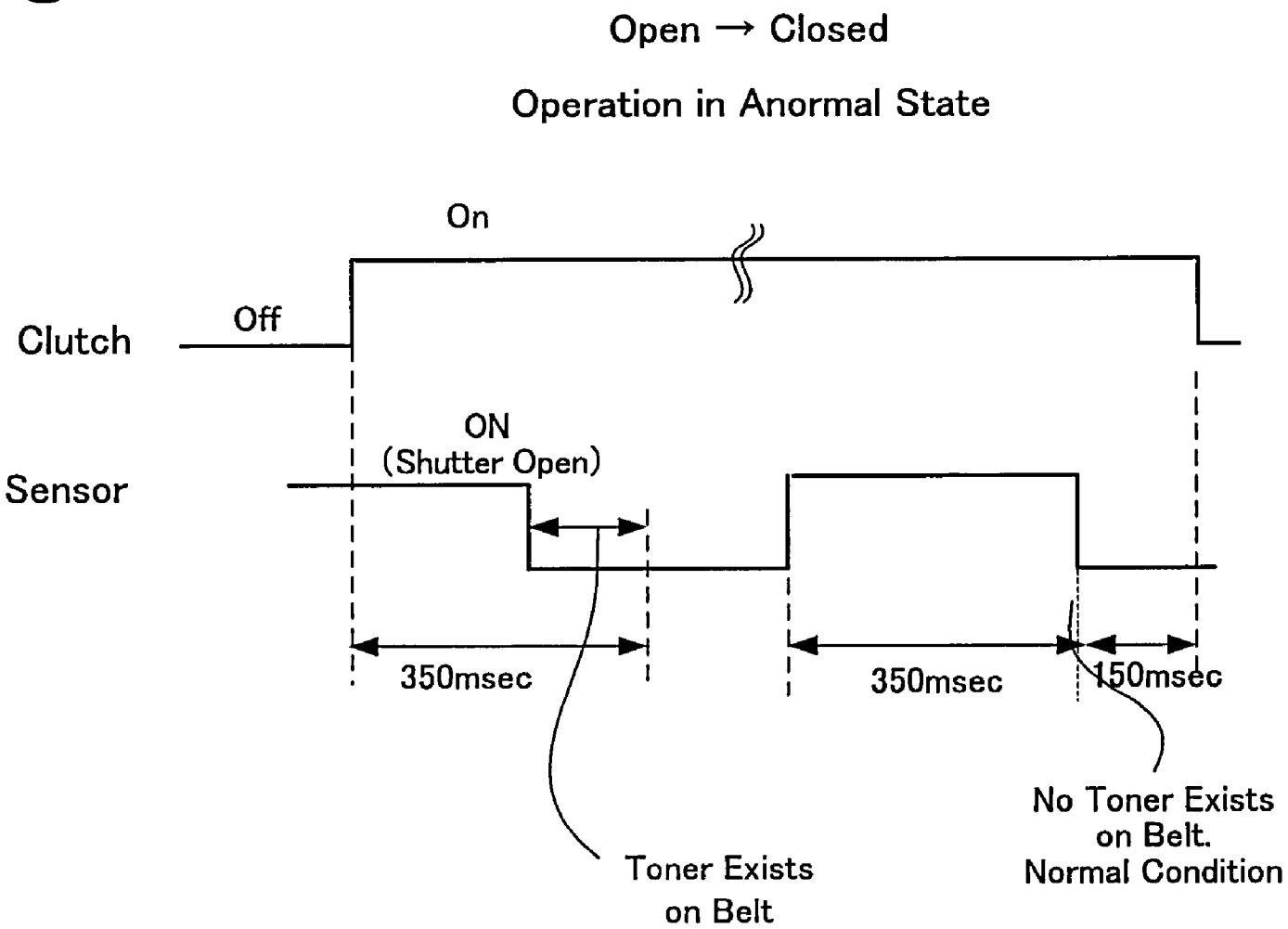
FIG. 17 is a time chart showing sensor output and clutch control in the case where control is performed following the above flow when an anormal output has occurred in the "open-to-closed" control of the shutter.

FIG. 17 shows a time chart for sensor output and clutch control in the case where the above flow control is performed following when an anormal output has occurred in the "open-to-closed" control.

Similarly to FIG. 16, since the toner patch exists on transfer belt 61 at the position detected by the optical sensor, the optical sensor becomes unable to detect reflected light before 350 msec±83 msec elapses. Hence, the operation is determined to be anormal at Step S44, and the control returns to Step S40 and is started over again. Then, the toner patch is conveyed away as transfer belt 61 moves, and the sensor turns "OFF" in a normal condition (after a lapse of 350 msec±83 msec).

This loop will be repeated a number of times until the normal state is restored. However, if the loop has been repeated 10 times or greater, it is determined that the detecting operation is totally abnormal and an error indication is given at Step S47.

At Steps S34, S42 and S43, a loop is formed so as to wait a change of the output from the sensor from when the timer is reset at Step S33 or S41. When no output change takes place after a lapse of 10 sec from timer reset (Step S38, S49 or S51; Yes), an error indication is given to end the operation (Steps S39, S50 and S52).

In the above way, in the image forming apparatus of the present invention, when the opening or closing of the shutter is detected based on the output of the optical sensor, it is possible to identify the erroneous detection of toner on the transfer belt and thereby prevent occurrence of mis-operation of the open/close control of the shutter.

The image forming apparatus of the present invention should not be limited to the above embodiment. It is obvious that various changes and modifications may be added without departing from the spirit and scope of the invention.

What is claimed is:

1. An image forming apparatus comprising:

a transfer belt for receiving a toner image from a photoreceptor;

a secondary transfer unit for transferring the toner image on the transfer belt to a recording medium;

an optical sensor for detecting a reference toner image on the transfer belt;

a shutter for protecting a detecting surface of the optical sensor;

an opening/closing portion for opening and closing the shutter; and, a controller for detecting the opening and closing of the shutter from an output from the optical sensor and controlling an opening and closing operation of the shutter based on the detected result, wherein the controller determines whether the optical sensor has erroneously detected the shutter being open or closed, and when occurrence of mis-detection is determined, repeating an opening and closing operation over again to perform detection, and further comprising:

a separation/contact mechanism for the transfer belt and the secondary transfer unit; and, a linkage mechanism for linking the opening and closing of the shutter with a separation and contact of the secondary transfer unit.

2. The image forming apparatus according to claim 1, wherein the linkage mechanism moves the shutter away from the transfer belt when the secondary transfer unit is pulled out from a main apparatus body.

3. The image forming apparatus according to claim 2, wherein the linkage mechanism includes a lever that abuts the secondary transfer unit and the shutter, the lever being moved by a driving mechanism so as to move the shutter and the secondary transfer unit into, and out of, contact with each other.

4. The image forming apparatus according to claim 1, wherein the optical sensor is a sensor that detects the density of a reference toner image on the transfer belt.

5. The image forming apparatus according to claim 1, wherein the optical sensor is a sensor that detects the position of a reference toner image of the transfer belt.

6. The image forming apparatus according to claim 1, wherein, when a plurality of optical sensors are provided, the optical sensors are adapted to use a common shutter.

7. The image forming apparatus according to claim 1, wherein the controller monitors change of the output from the optical sensor and performs an error process when no change has been observed for a predetermined period of time or longer.

* * * * *